US006957681B2

(12) United States Patent
Kim

(10) Patent No.: US 6,957,681 B2
(45) Date of Patent: Oct. 25, 2005

(54) EMBEDDED TYPE MOTORIZED BLIND DEVICE

(75) Inventor: Dong Ik Kim, Bucheon (KR)

(73) Assignee: Winspia Co., Ltd., Siheung (KR)

( * ) Notice: Subject to any disclaimer, the term of this patent is extended or adjusted under 35 U.S.C. 154(b) by 153 days.

(21) Appl. No.: 10/704,248

(22) Filed: Nov. 7, 2003

(65) Prior Publication Data

US 2005/0067117 A1 Mar. 31, 2005

(30) Foreign Application Priority Data

Sep. 26, 2003 (KR) ..... 10-2003-0067068

(51) Int. Cl.[7] ..... E06B 9/30

(52) U.S. Cl. ..... 160/168.1 P; 160/171; 160/DIG. 17

(58) Field of Search ..... 160/168.1 P, 168.1 R, 160/170, 171, 172 R, 173 R, 176.1 P, 84.02, 188, DIG. 17

(56) References Cited

U.S. PATENT DOCUMENTS 3,308,873 A * 3/1967 Dotto ..... 160/176.1 P
3,809,143 A * 5/1974 Ipekgil ..... 160/168.1 P
4,096,903 A * 6/1978 Ringle, III ..... 160/176.1 P
6,253,822 B1 * 7/2001 Wootton ..... 160/168.1 P
6,659,156 B2 * 12/2003 Wen et al. ..... 160/168.1 P

FOREIGN PATENT DOCUMENTS

JP 05-065785 3/1993

* cited by examiner

*Primary Examiner*—David Purol
(74) *Attorney, Agent, or Firm*—Frommer Lawrence & Haug LLP; Ronald R. Santucci

(57) ABSTRACT

An embedded type motorized blind device. A power supply section has a motor. A power transmitting section has a worm gear coupled to the shaft of the power supply section, a worm wheel positioned on and meshed with the worm gear, a planetary gear formed on a side surface of the worm wheel, and a quadrangular shaft formed integrally with a front end of the worm gear. A control section has an internal sun gear meshed with the planetary gear, a pair of swing arms securely locked to a center shaft fastened to a bottom wall of the internal sun gear, and a pair of limit switches operated by lower ends of the swing arms to control raising and lowering of a blind. An operating section has raising and lowering drums connected one with another, and tilt adjustment parts respectively placed on the raising and lowering drums.

4 Claims, 5 Drawing Sheets

EMBEDDED TYPE MOTORIZED BLIND DEVICE

This application claims priority benefits from Korean Patent Application No. 10-2003-67086 filed Sep. 26, 2003.

BACKGROUND OF THE INVENTION

1. Field of the Invention

The present invention relates, in general, to an embedded type motorized blind device and, more particularly, to an embedded type motorized blind device which has minimal thickness of a blind incorporating window, which prevents the generation of an overload even in a motor of a large-sized window to be reliably operated and precisely controlled, and which is installed to allow a power supply interruption time to be conveniently and precisely set.

2. Description of the Prior Art

Generally, a blind is a window covering which has horizontal or vertical slats that can be drawn out of the way, often with the angle of the slats adjustable to admit varying amounts of light. From old times, as means for performing the same function as the blind, a reed blind, a sliding screen, a latticework, a shutter, a Venetian blind, etc. have been developed. Recently, a roller shade for rolling a fabric sheet using a spring, a double glazed window unit incorporating a Venetian blind therein, etc. have been disclosed in the art.

In addition to the removably and movably structured blinds, shading devices which are permanently incorporated into buildings have also been disclosed in the art.

While a building has a basic function of isolating an influence from the external environment to some extent, a blind serves as means for rendering a pleasant appearance and decorating natural characteristics of a building.

It has been known that a blind is very advantageous for efficient thermal insulation. This is a result of an air layer formed between the blind and a window.

It is generally required that a blind directly blocks the beams of light and another's gaze, allows some air circulation and an indirect beams of light, ensures visibility from the inside to the outside, and is capable of being removed or moved as occasion demands.

A louver type blind is widely used.

The louver indicates a series of narrow slats which are arranged parallel one to another. By changing an angle of the slats, it is possible to shade the light.

A Venetian blind is most widely used as a blind. In the Venetian blind, horizontal slats painted with a light color and having a curvature are foldably placed behind a window so that they are overlapped in such a way as to be opened or closed to thereby admit varying amounts of light.

These days, motorized blind devices have been disclosed in the art, in which motors are coupled to various blinds to enable automatic control of the blinds. The motorized blind devices are installed in double-glazed window units to be externally and automatically controlled in their operations.

In each of these conventional embedded type motorized blind devices, a raising or lowering amount of the blind and an angle of slats are adjusted using gears, an arithmetic unit, or a timer.

However, the conventional embedded type motorized blind devices suffer from defects in that, when they are installed, it is difficult to precisely set a time for interrupting power supply to a driving unit at uppermost and lowermost positions of the blind in conformity with a varying size of a window, by which an installation time is increased and a skillful person is required.

Also, in the conventional embedded type motorized blind devices, a wound amount of a raising and lowering cord cannot be precisely detected, by which an overload may be applied to a motor to shorten a life span thereof and thereby a wound portion of the cord is likely to be broken.

Further, in the case that the conventional embedded type motorized blind device is incorporated in a large-sized window, since an elongate head box should be installed to extend in a transverse direction, a straightness of a rotating shaft is deteriorated to generate an overload in the motor, by which the motor can be further shortened in its available life span and malfunction of the motor may be caused.

Moreover, because the conventional embedded type motorized blind devices have complicated structures and substantial widths, when they are incorporated in double-glazed window units, a thickness of each window unit cannot but be increased.

SUMMARY OF THE INVENTION

Accordingly, the present invention has been made keeping in mind the above problems occurring in the prior art, and an object of the present invention is to provide an embedded type motorized blind device which allows uppermost and lowermost positions of a blind to be conveniently and precisely set, to thereby improve working efficiency when installing the device.

Another object of the present invention is to provide an embedded type motorized blind device which allows a raising and lowering cord to be precisely wound on a drum, to thereby protect a motor, prevent a wound portion of the cord from being broken, lengthen an available life span of the device, and ensure operational precision even when the device is used for extended periods.

Still another object of the present invention is to provide an embedded type motorized blind device which is constructed not to deteriorate a straightness of a rotating element even when the device is incorporated in a large-sized window, to thereby prevent a motor from being overly loaded and extend a life span of the motor.

Yet still another object of the present invention is to provide an embedded type motorized blind device which has a simple construction and a decreased width, to allow a double-glazed window unit incorporating the device to be minimized in its thickness.

In order to achieve the above objects, according to the present invention, there is provided an embedded type motorized blind device comprising: a power supply section having a motor which is connected to a reducer for reducing rotation force to a predetermined rpm to rotate a shaft; a power transmitting section having a worm gear which is coupled in a lengthwise direction thereof to the shaft of the power supply section, a worm wheel which is positioned on and meshed with the worm gear, a planetary gear which is formed on a side surface of the worm wheel, and a quadrangular shaft which is formed integrally with a front end of the worm gear; a control section having an internal sun gear which is meshed with the planetary gear of the power transmitting section, a pair of swing arms which are securely locked to a center shaft fastened to a bottom wall of the internal sun gear, and a pair of limit switches which are operated by lower ends, respectively, of the swing arms to control raising and lowering of a blind; and an operating section having a plurality of raising and lowering drums one of which is fitted around the quadrangular shaft of the power transmitting section and the others of which are sequentially connected one with another by connection shafts, and tilt adjustment parts which are respectively placed on the raising and lowering drums.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
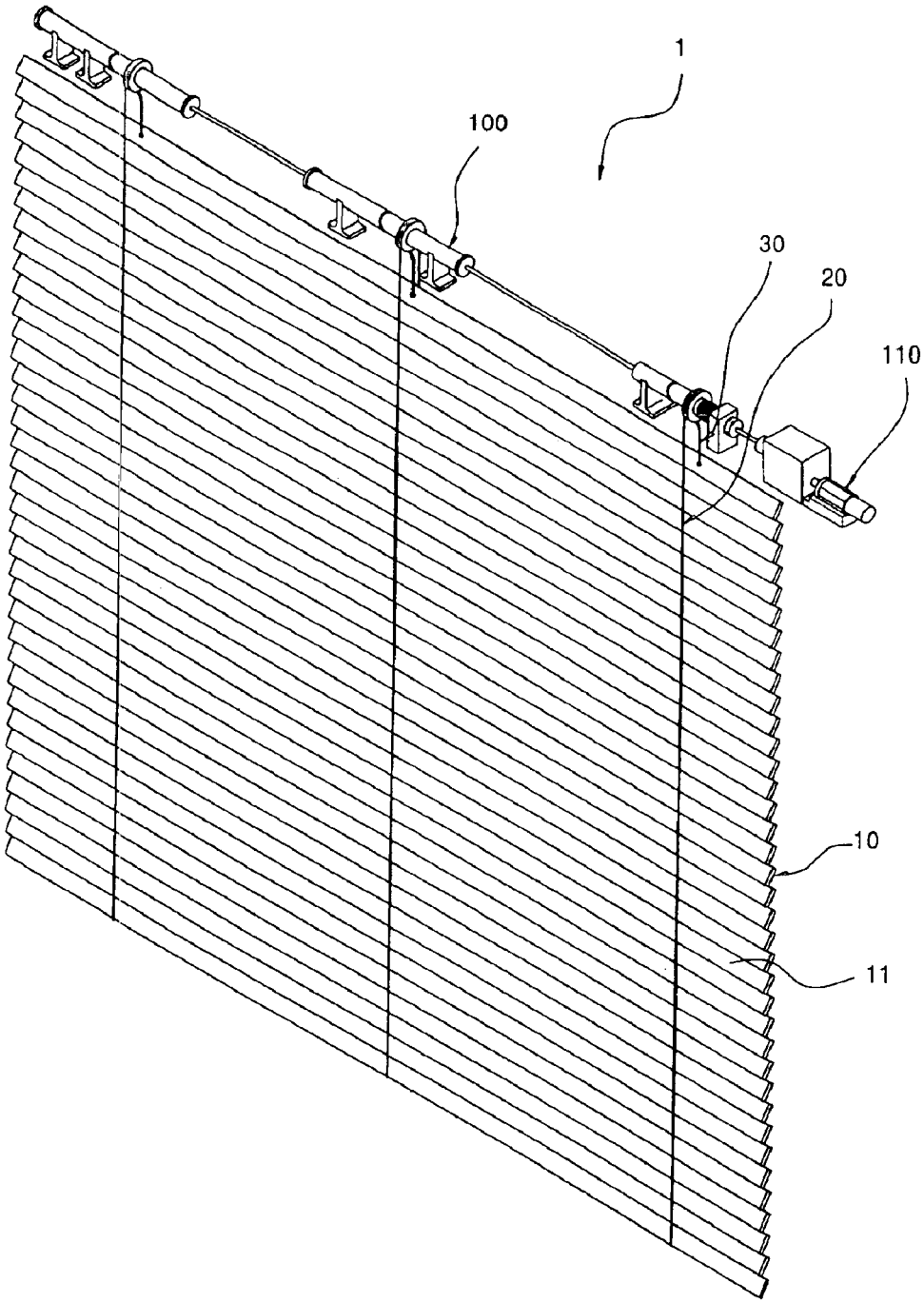
FIG. 1 is a perspective view illustrating an entire construction of an embedded type motorized blind according to the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
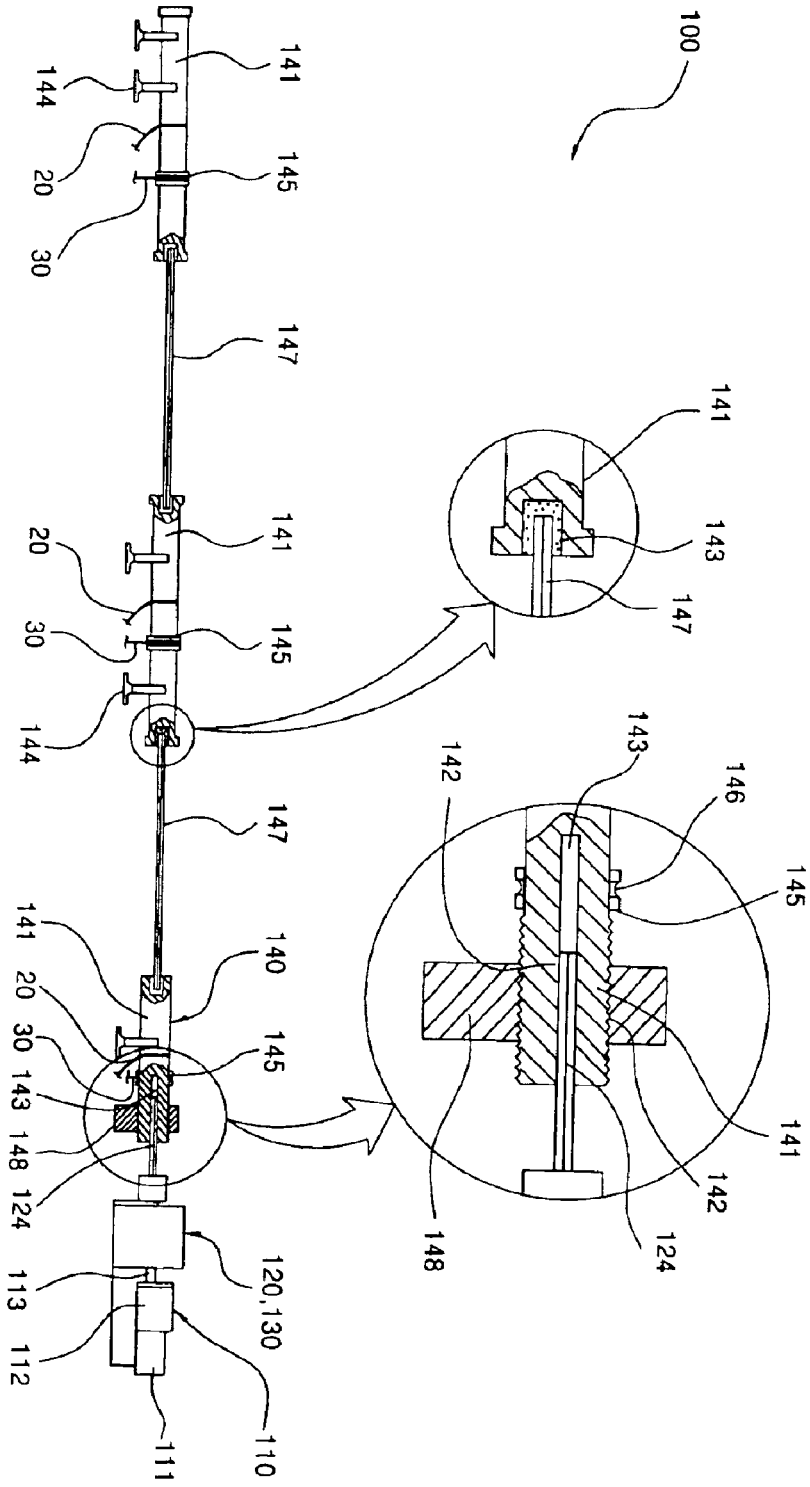
FIG. 2 is a front view illustrating an embedded type motorized blind device in accordance with an embodiment of the present invention.
Figure 3:
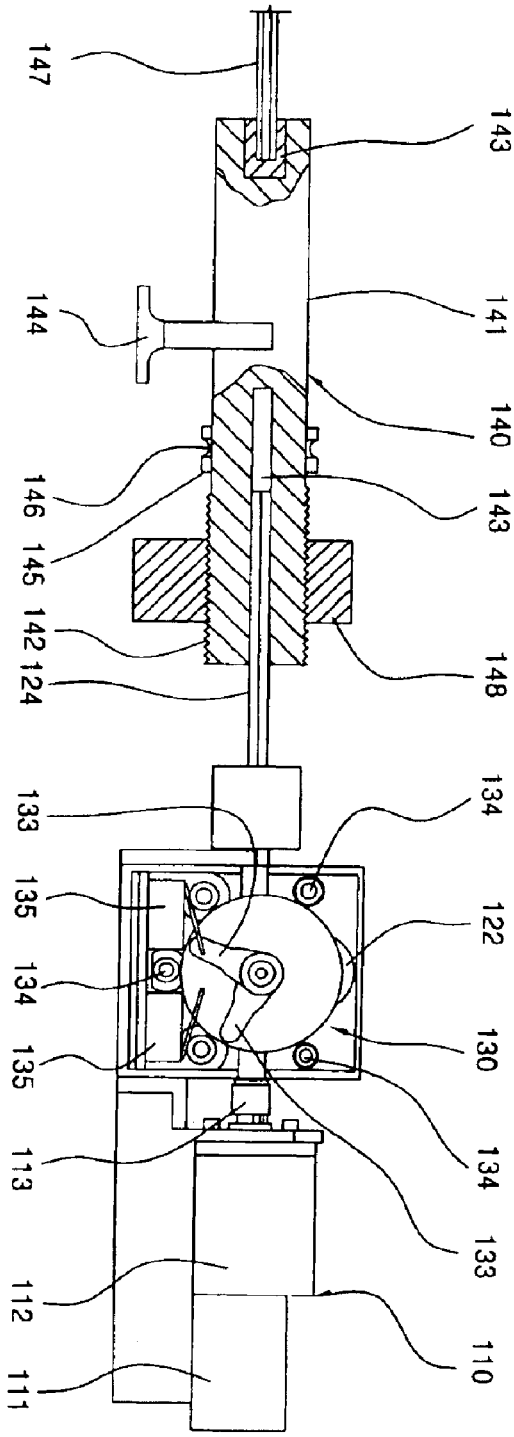
FIG. 3 is a front view illustrating a driving section which is positioned at an end of the embedded type motorized blind device according to the present invention.
Figure 4:
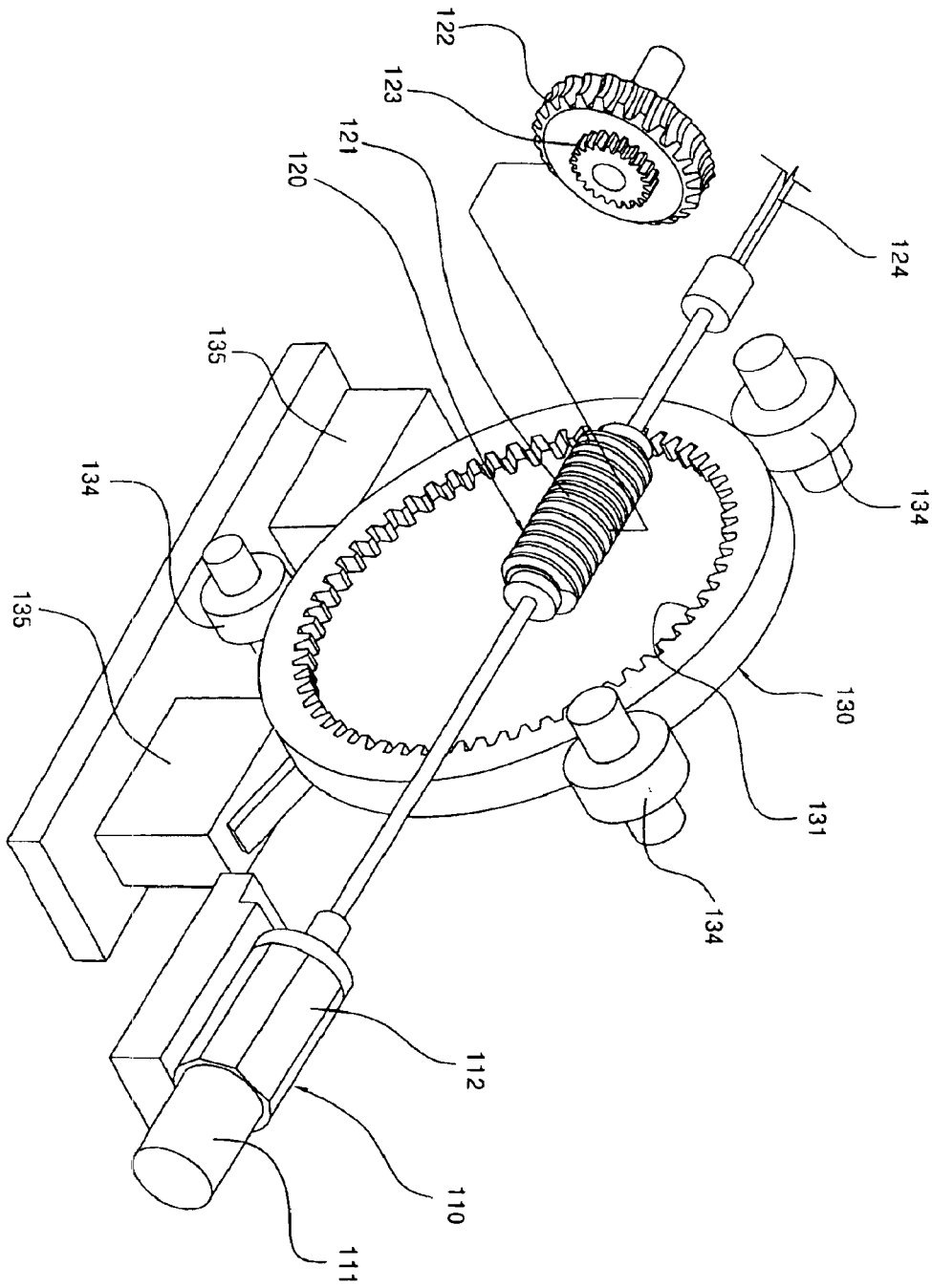
FIG. 4 is an exploded perspective view illustrating the other end of the embedded type motorized blind device according to the present invention.
Figure 5:
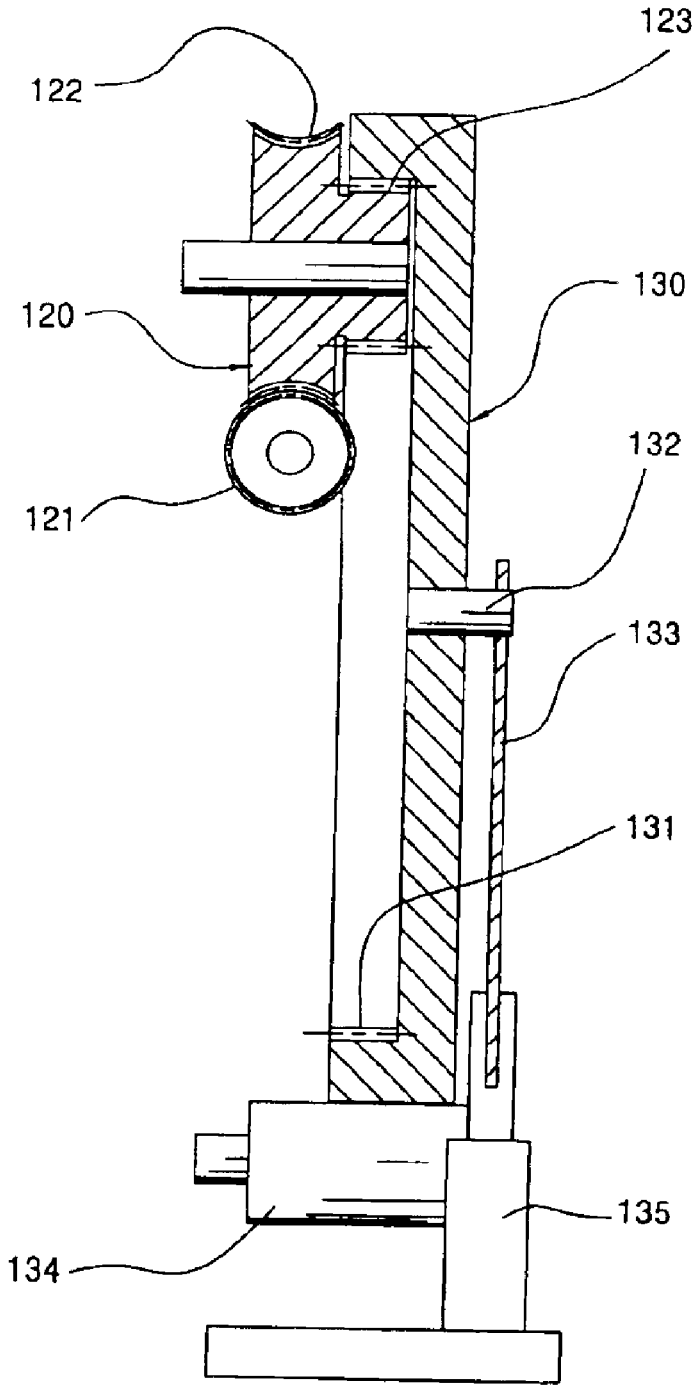
FIG. 5 is a side view illustrating a partially assembled state of the embedded type motorized blind device according to the present invention.

FIG. 1 is a perspective view illustrating an entire construction of an embedded type motorized blind according to the present invention; FIG. 2 is a front view illustrating an embedded type motorized blind device in accordance with an embodiment of the present invention; FIG. 3 is a front view illustrating a driving section which is positioned at an end of the embedded type motorized blind device according to the present invention; FIG. 4 is an exploded perspective view illustrating the other end of the embedded type motorized blind device according to the present invention; and FIG. 5 is a side view illustrating a partially assembled state of the embedded type motorized blind device according to the present invention.

As shown in FIGS. 1 through 5, an embedded type motorized blind device 100 in accordance with an embodiment of the present invention includes a power supply section 110, a power transmitting section 120, a control section 130, and an operating section 140. The power supply section 110 has a motor 111 which is connected to a reducer 112 for reducing rotation force to a predetermined rpm to rotate a shaft 113. The power transmitting section 120 has a worm gear 121 which is coupled in a lengthwise direction thereof to the shaft 113 of the power supply section 110, a worm wheel 122 which is positioned on and meshed with the worm gear 121, a planetary gear 123 which is formed on a side surface of the worm wheel 122, and a quadrangular shaft 124 which is formed integrally with a front end of the worm gear 121. The control section 130 has an internal sun gear 131 which is meshed with the planetary gear 123 of the power transmitting section 120, a pair of swing arms 133 which are securely locked to a center shaft 132 fastened to a bottom wall of the internal sun gear 131, and a pair of limit switches 135 which are operated by lower ends, respectively, of the swing arms 133 to control raising and lowering of a blind 1. The operating section 140 has a plurality of raising and lowering drums 141 one of which is fitted around the quadrangular shaft 124 of the power transmitting section 120 and the others of which are sequentially connected one with another by connection shafts 147, and tilt adjustment parts 145 which are respectively placed on the raising and lowering drums 141.

In the power supply section 110, the reducer 112 is integrally formed with the motor 111 to reduce a velocity of the motor 111 to the predetermined rpm.

In the power transmitting section 120, it is preferred that the worm wheel 122 is vertically positioned on and meshed with the worm gear 121 to minimize a width of the device according to the present invention.

Here, the planetary gear 123 is formed on the side surface of the worm wheel 122.

In the control section 130, it is preferred that the internal sun gear 131 is vertically erected and meshed with the planetary gear 123 formed on the side surface of the worm wheel 122 to minimize a width of the device according to the present invention.

Here, a plurality of guide rollers 134 are placed around the sun gear 131 so that the sun gear 131 can be set at a precise position and reliably rotated. The guide rollers 134 are coupled to the a head box.

Further, the center shaft 132 is fastened to the bottom wall of the internal sun gear 131 to project out of a side surface of the bottom wall which is remote from the internal sun gear 131, and the pair of swing arms 133 for controlling raising and lowering of the blind 1 are securely locked to the center shaft 132.

Concretely speaking, the pair of limit switches 135 are arranged at left and right sides below the sun gear 131 to be operated by the lower ends, respectively, of the swing arms 133. In this regard, with a louver 10 of the blind 1 fully lowered to be maintained in an unfolded state, one swing arm 133 is set to the center shaft 132 of the sun gear 131, and with the louver 10 of the blind 1 fully raised to be maintained in a folded state, the other swing arm 133 is set to the center shaft 132 of the sun gear 131. In these ways, the pair of swing arms 133 are rigidly fastened to the center shaft 132. Due to this fact, a worker can conveniently and quickly install the blind 1 in a precise manner to prevent overloaded motor 111.

In the operating section 140, one of the raising and lowering drums 141 is fitted in a lengthwise direction thereof around the quadrangular shaft 124 of the power transmitting section 120, and the others of the raising and lowering drums 141 are sequentially connected one with another by the connection shafts 147.

Here, each of the raising and lowering drums 141 are defined at both ends thereof with hexagonal shaft holes 143, and each of the connection shafts 147 are formed to have a hexagonal rod-shaped configuration so that it can be precisely rotated. An adhesive having a predetermined softness property is filled in the hexagonal shaft holes 143 so that a slightly flexible state is maintained in joint regions. Therefore, in the case that the blind 1 is installed to a window having a substantial length measured from left to right, a straightness of a shaft can be improved to prevent overloading component parts such as the motor 111.

Further, it is preferred that a raising and lowering cord 30 is wound on the raising and lowering drum 141, and one or more support fixtures 144 are mounted to a lower end of each raising and lowering drum 141.

Each of the tilt adjustment parts 145 respectively placed on the raising and lowering drums 141 is defined with an annular guide groove 146. An upper end of a tilt cord 20 having a ladder-shaped contour is wound in the annular guide groove 146.

Each tilt adjustment part 145 is fitted around the raising and lowering drum 141 to have a predetermined degree of frictional force, so that the tilt adjustment part 145 is maintained as it is while the raising and lowering drum 141 is rotated at a high speed and rotated in an interlocked manner with the raising and lowering drum 141 while the raising and lowering drum 141 is rotated at a low speed (which is actually very slow).

Concretely speaking, when raising and lowering the blind 1, since the raising and lowering drum 141 is rotated at a high speed, the tilt adjustment part 145 is held stationary. When adjusting an angle of slats 11 constituting the louver 10 to admit varying amounts of light, since the raising and lowering drum 141 is rotated at a very slow speed, the tilt adjustment part 145 is also rotated in an interlocked manner with the raising and lowering drum 141 by the frictional force developed between them, by which an angle of the slats 11 is adjusted as desired.

At this time, because an actual rotation angle is very fine to the extent of 85° in each of leftward and rightward directions, a substantial change is not caused in a height of the blind 1.

In the meanwhile, an external thread 142 is formed on a circumferential outer surface of one end of the raising and lowering drum 141 which is connected with the quadrangular shaft 124 of the power transmitting section 120. A support member 148 which is formed with an internal thread is assembled with the raising and lowering drum 141 so that the external thread 142 and the internal thread are coupled with each other. The raising and lowering drum 141 which is positioned adjacent to the power transmitting section 120 is defined, at one end thereof facing the power transmitting section 120, with a quadrangular shaft hole 143, whereby, when the shaft 124 is simply inserted into the quadrangular shaft hole 143 and then rotated, the raising and lowering drum 141 can be moved in a lengthwise direction thereof.

Concretely speaking, if the quadrangular shaft 124 is rotated, due to the presence of the external thread 142 which is threadedly coupled to the internal thread of the support member 148, the raising and lowering drum 141 can be moved forward and rearward while being rotated.

That is to say, due to the fact that rotation and linear motion of the raising and lowering drums 141 are simultaneously implemented, when the raising and lowering drums 141 can be rotated forward or backward while being moved forward or rearward. Due to this fact, as the raising and lowering cord 30 can be wound on and unwound from the raising and lowering drum 141, it is possible to raise and lower the blind 1 in a precise manner.

Hereafter, operations of the embedded type motorized blind device according to the present invention, constructed as mentioned above, will be described.

First, when it is necessary to raise or lower the louver 10 of the blind 1, by controlling the motor 111, appropriate rotation force of a predetermined rpm is transmitted to the worm wheel 121 through the reducer 112. For this reason, the raising and lowering drums 141 which are connected one with another in their lengthwise direction are rotated in forward or backward directions to raise or lower the louver 10 to a desired level.

If the louver 10 reaches a desired level, power supply to the motor 111 is interrupted to stop the operation of the blind device.

Here, when it is necessary to fully fold the blind 1 to the uppermost position or fully unfold the blind 1 to the lowermost position, the above-described procedure is continuously implemented.

At this time, as the worm gear 121 is continuously rotated, the worm wheel 122 which is positioned on and meshed with the worm gear 121 is also continuously rotated. Thus, the planetary gear 123 formed integrally with the worm wheel 122 is rotated, and thereby the sun gear 131 is rotated.

Due to this fact, as one swing arm 133 which is initially set on the center shaft 132 of the sun gear 131 presses one limit switch 135, power supply to the motor 111 is interrupted with the louver 10 of the blind 1 being in the fully unfolded state or the fully folded state, whereby operation of the blind 1 is automatically stopped, and in this way, it is possible to prevent overloading the motor 111.

Since the raising and lowering drums 141 are moved forward or rearward while being rotated forward or backward, the raising and lowering cords 30 can be wound on or unwound from the raising and lowering drums 141 in the form of a coil, whereby the raising and lowering cords 30 can precisely raise and lower the blind 1 without causing portions of each cord 30 to be superimposed one upon another.

Here, the tilt adjustment parts 145 are held stationary even though the raising and lowering drums 141 are rotated.

On the other hand, when it is necessary to adjust an angle of the slats 11 constituting the louver 10 of the blind 1 to admit varying amounts of light, the motor 111 is driven at a low speed. Due to this fact, as rotation force is slowly transmitted to the tilt adjustment parts 145, the tilt adjustment parts 145 are rotated integrally with the raising and lowering drums 141 due to the frictional force developed between them. In this way, an angle of the slats 11 is adjusted as desired.

At this time, because an actual rotation angle is very fine to the extent of 170° through leftward and rightward directions, a substantial change is not caused in a height of the blind 1.

As apparent from the above description, the present invention provides an embedded type motorized blind device comprising: a power supply section having a motor which is connected to a reducer for reducing rotation force to a predetermined rpm to rotate a shaft; a power transmitting section having a worm gear which is coupled in a lengthwise direction thereof to the shaft of the power supply section, a worm wheel which is positioned on and meshed with the worm gear, a planetary gear which is formed on a side surface of the worm wheel, and a quadrangular shaft which is formed integrally with a front end of the worm gear; a control section having an internal sun gear which is meshed with the planetary gear of the power transmitting section, a pair of swing arms which are securely locked to a center shaft fastened to a bottom wall of the internal sun gear, and a pair of limit switches which are operated by lower ends, respectively, of the swing arms to control raising and lowering of a blind; and an operating section having a plurality of raising and lowering drums one of which is fitted around the quadrangular shaft of the power transmitting section and the others of which are sequentially connected one with another by connection shafts, and tilt adjustment parts which are respectively placed on the raising and lowering drums.

Therefore, in the present invention, uppermost and lowermost positions of a blind can be conveniently and precisely set, to thereby improve working efficiency when installing the device. Also, a raising and lowering cord can be precisely wound on a drum, to thereby protect a motor and prevent a wound portion of the cord from being broken. Further, a straightness of a rotating element is not deteriorated even when the device is incorporated in a large-sized window, whereby it is possible to prevent overloading a motor and extend a life span of the motor. Moreover, the device has a decreased width to allow a double-glazed window unit incorporating the device to be minimized in its thickness.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An embedded type motorized blind device comprising:

a power supply section having a motor which is connected to a reducer for reducing rotation force to a predetermined rpm to rotate a shaft;

a power transmitting section having a worm gear which is coupled in a lengthwise direction thereof to the shaft of the power supply section, a worm wheel which is positioned on and meshed with the worm gear, a planetary gear which is formed on a side surface of the worm wheel, and a quadrangular shaft which is formed integrally with a front end of the worm gear;

a control section having an internal sun gear which is meshed with the planetary gear of the power transmitting section, a pair of swing arms which are securely locked to a center shaft fastened to a bottom wall of the internal sun gear, and a pair of limit switches which are operated by lower ends, respectively, of the swing arms to control raising and lowering of a blind; and an operating section having a plurality of raising and lowering drums one of which is fitted around the quadrangular shaft of the power transmitting section and the others of which are sequentially connected one with another by connection shafts, and tilt adjustment parts which are respectively placed on the raising and lowering drums.

2. The embedded type motorized blind device as set forth in claim 1, wherein, in the operating section, each of the raising and lowering drums are defined at both ends thereof with hexagonal shaft holes; each of the connection shafts are formed to have a hexagonal rod-shaped configuration so that it can be precisely rotated; and an adhesive having a predetermined softness property is filled in the hexagonal shaft holes so that a slightly flexible state is maintained in joint regions.

3. The embedded type motorized blind device as set forth in claim 1, wherein, in the operating section, each of the tilt adjustment parts respectively placed on the raising and lowering drums is defined with an annular guide groove; an upper end of a tilt cord having a ladder-shaped contour is wound in the annular guide groove; and each tilt adjustment part is fitted around the raising and lowering drum to have a predetermined degree of frictional force so that the tilt adjustment part is maintained as it is while the raising and lowering drum is rotated at a high speed and rotated in an interlocked manner with the raising and lowering drum while the raising and lowering drum is rotated at a low speed.

4. The embedded type motorized blind device as set forth in claim 1, wherein an external thread is formed on a circumferential outer surface of one end of the raising and lowering drum which is connected with the quadrangular shaft of the power transmitting section; a support member which is formed with an internal thread is assembled with the raising and lowering drum so that the external and internal threads are coupled with each other; and the raising and lowering drum positioned adjacent to the power transmitting section is defined, at one end thereof facing the power transmitting section, with a quadrangular shaft hole, whereby, when the shaft is simply inserted into the quadrangular shaft hole and then rotated, the raising and lowering drum can be moved in a lengthwise direction thereof.

* * * * *